US005314376A

United States Patent [19]

Kuramarohit

[11] Patent Number: 5,314,376

[45] Date of Patent: May 24, 1994

[54] AIR CONDITIONER

[76] Inventor: Kullapat Kuramarohit, P.O. Box 23, Maggasan P.O., Bankgkok 10402, Thailand

[21] Appl. No.: 590,794

[22] Filed: Oct. 1, 1990

[51] Int. Cl.[5] ..... F24F 7/10

[52] U.S. Cl. ..... 454/186; 454/65; 454/228; 454/236

[58] Field of Search ..... 454/185, 186, 228, 230, 454/233, 236, 49, 65

[56] References Cited

U.S. PATENT DOCUMENTS

| | | | |
|---|---|---|---|
| 3,026,789 | 3/1962 | Mead | 454/49 |
| 3,657,991 | 4/1972 | Oberg | 454/237 X |
| 4,355,568 | 10/1982 | Steckley | 454/237 |
| 4,549,472 | 10/1985 | Endo et al. | 454/237 |
| 5,096,477 | 3/1992 | Shinoda et al. | 454/228 X |

FOREIGN PATENT DOCUMENTS

| | | | |
|---|---|---|---|
| 100327 | 6/1984 | Japan | 454/233 |
| 711753 | 7/1954 | United Kingdom | 454/237 |

*Primary Examiner*—Harold Joyce

*Attorney, Agent, or Firm*—Wigman, Choen, Leitner & Myers

[57] ABSTRACT

A room comprise of localized region (10) for air conditioning wherein conditioned air or totally fresh air can be directed to certain region of the room. A path of air flow may comprised of a ceiling air collector/distributor (80) joining with a floor air collector/distributor (41) by a duct (18) having the localized air conditioning region (10) link the floor air collector/distributor to the ceiling air collector/distributor to complete the circuit while maintaining the characteristic of air conditioning specific portion of the room only but not the whole room.

7 Claims, 7 Drawing Sheets

AIR CONDITIONER

This invention relates to air conditioning apparatus.

FIELD OF INVENTION

This invention has particular but not exclusive application to the heating and/or cooling of a localized region within of a room, and for illustrative purposes reference will be made to such application. However, it is to be understood that this invention could be used in other applications, such as the re-use of hot or cold air extracted from one room to heat or cool another room.

BACKGROUND

Present air conditioning apparatus are designed to heat or cool the air circulated within a room. Where persons are seated at a desk for long periods of time, as may be the case in many commercial offices, the heating or cooling of the air not immediately surrounding the person is both unnecessary and constitutes a waste of energy.

OBJECTIVES

The present invention aims to alleviate the above disadvantages and to provide an air conditioning apparatus which will be reliable and efficient in use. Other objects and advantages of this invention will hereinafter become apparent.

NATURE OF THE INVENTION

With the foregoing and other objects in view, this invention in one aspect resides broadly in an air conditioning apparatus including:

- air distribution means for delivering air to a zone to be conditioned;
- air collection means for collecting air from said zone, and
- ducting means for transferring air from said air collection means to said air distribution means. Preferably said apparatus also includes fans adapted to drive air through said air distribution means.

The air collection means or air distribution means in one embodiment may include a first opening preferably located in the ceiling of a room. However, an opening may be provided in a wall of the room preferably adjacent to the ceiling and the region to be supplied with air. The opening, in one embodiment, may include a housing and a fan mounted within the housing. The fan is preferably adapted to drive air through the housing thereby generating a flow of air through the ducting. The housing may also include a cooling element adapted to cool the air passed therethrough. The housing may also include a funnel shaped extension dependent therefrom having an access opening positioned above the localized region and wherein use, the funnel may assist in the collection and passage of air through the housing.

The funnel may be integral with or attached to the housing and may include a continuous side wall or a plurality of side walls. The walls may be manufactured from a metal, plastics, paper, cotton or synthetic material and may be constructed so as to permit the folding or retraction of the wall or walls toward the ceiling. In one embodiment the funnel may include four walls each constructed from a sheet of flexible plastics material. The lower edges of each sheet are preferably connected to a draw string or the like which may be used to raise the lower edges of the walls. The walls may each include a number of horizontally orientated fold lines which permit the folding of the wall in a concertina fashion.

The air collection means or the air distribution means in yet another embodiment may include a second opening located in a wall of the room adjacent to the floor or alternatively, in the floor immediately below the region to be supplied with air or from which air is to be extracted. The second opening, in one embodiment, may include a housing and a fan mounted within the housing. The fan is preferably adapted to drive air through the housing. The housing may also include a heating element fitted thereto.

In an alternative embodiment, the floor may include any number of tubular passageways in which are formed inlet or outlet ports through which air may pass to or from the localized region. The passageways are preferably arranged so as to form a network of inlet or outlet ports which may supply air to or collect air from a number of localized regions in a room and which may be selectively opened and closed.

The ducting in one embodiment may include a length of tubing connecting the first opening and the second opening. The tubing may be manufactured from a metal, plastics or paper material. In one embodiment, the tubing may extend between external fittings fluidly connected to the first and second openings respectively. Preferably the ends of the ducting are releasably connected to the external fittings thereby enabling the ducting to be removed when not required.

In an alternative embodiment, the ducting may include lengths of tubing or a number of passageways contained behind walls or within columns located within the room. In one embodiment, the passageways connecting the first and second openings are defined by the region separating the ceiling and a floor above, and an internal wall of the room or of the ducting and an external wall of the office or dwelling.

The ducting may also be fluidly connected to a source of fresh air thereby enabling fresh air to be introduced into the localized region. To force the flow of air through the ducting, the ducting may include one or more fans positioned therealong. The ducting may also include a heating element and/or a cooling element contained therein which may be used to condition the air flowing through the ducting. However, in alternative embodiments, both heating and cooling elements may be attached to the first and second openings or positioned in the room in front of the first and second openings.

The actuation means may control the extent to which the openings are opened or closed and the volume of fresh air which may be introduced into the apparatus. Where the apparatus is used to either heat or cool the air circulating within the localized region, the actuation means preferably enables the apparatus to be reversed enabling the apparatus to be used to selectively heat or cool the air supplied to the localized region.

DRAWINGS

In order that this invention may be more easily understood and put into practical effect, reference will now be made to the accompanying drawings which illustrate a preferred embodiment of the invention, wherein.

Figure 9:
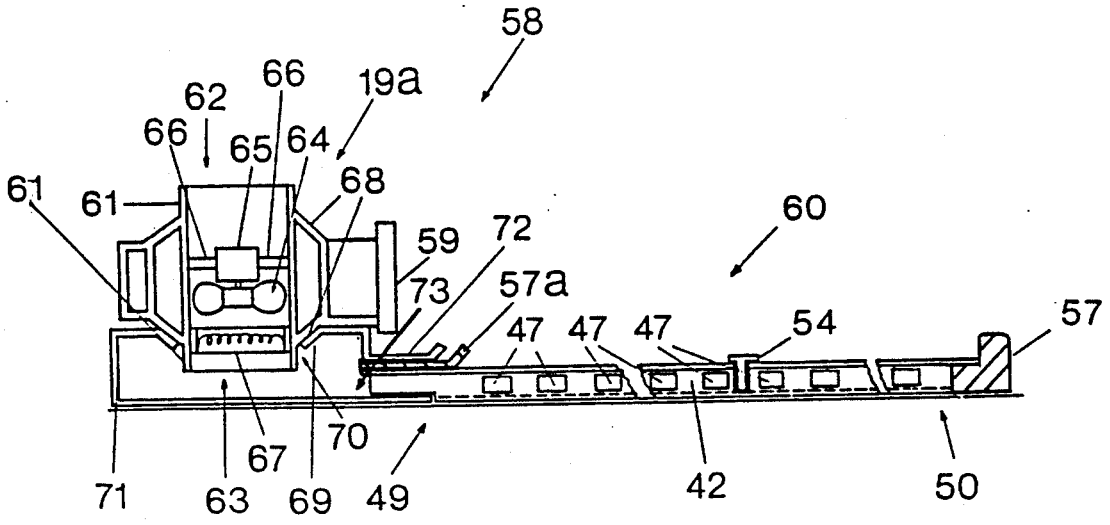
Figure 10:
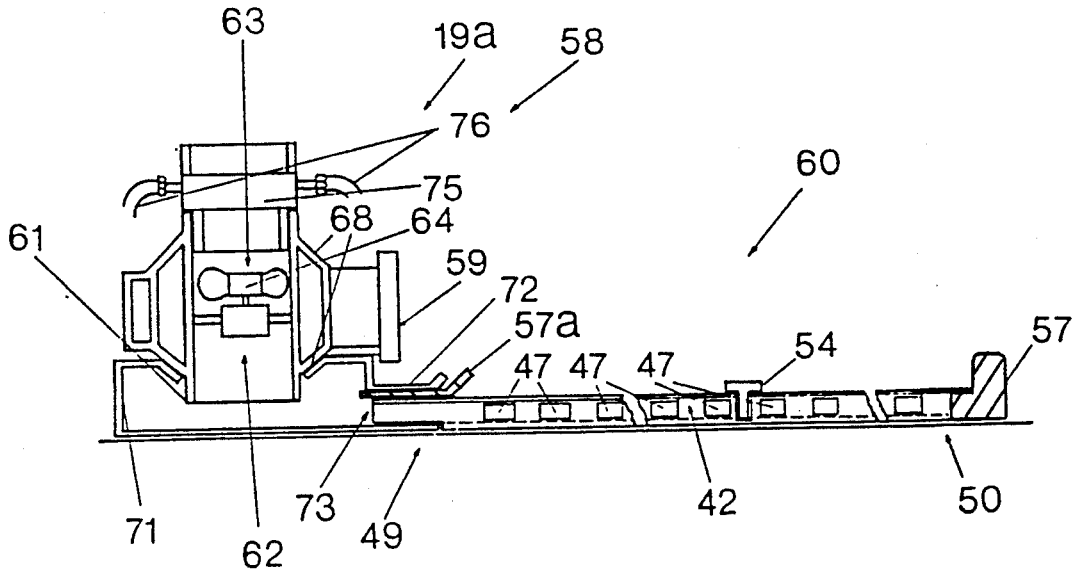
Figure 11:
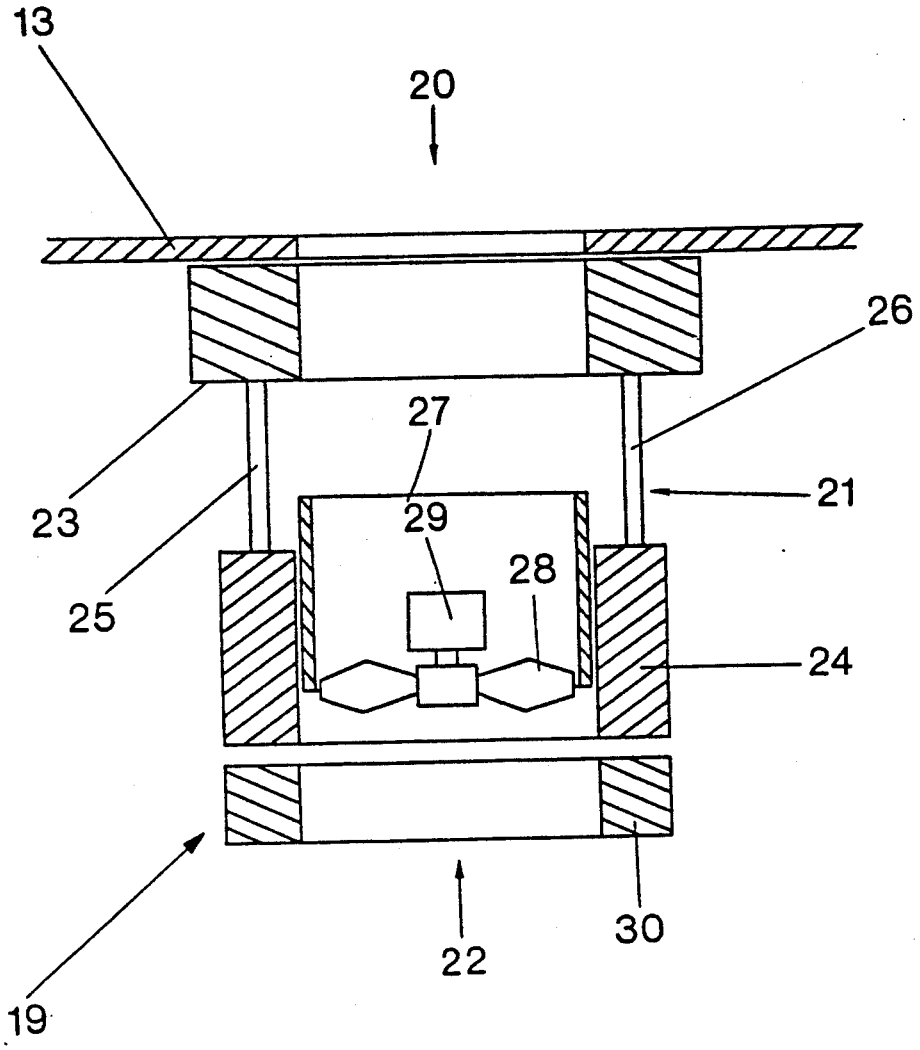
Figure 12:
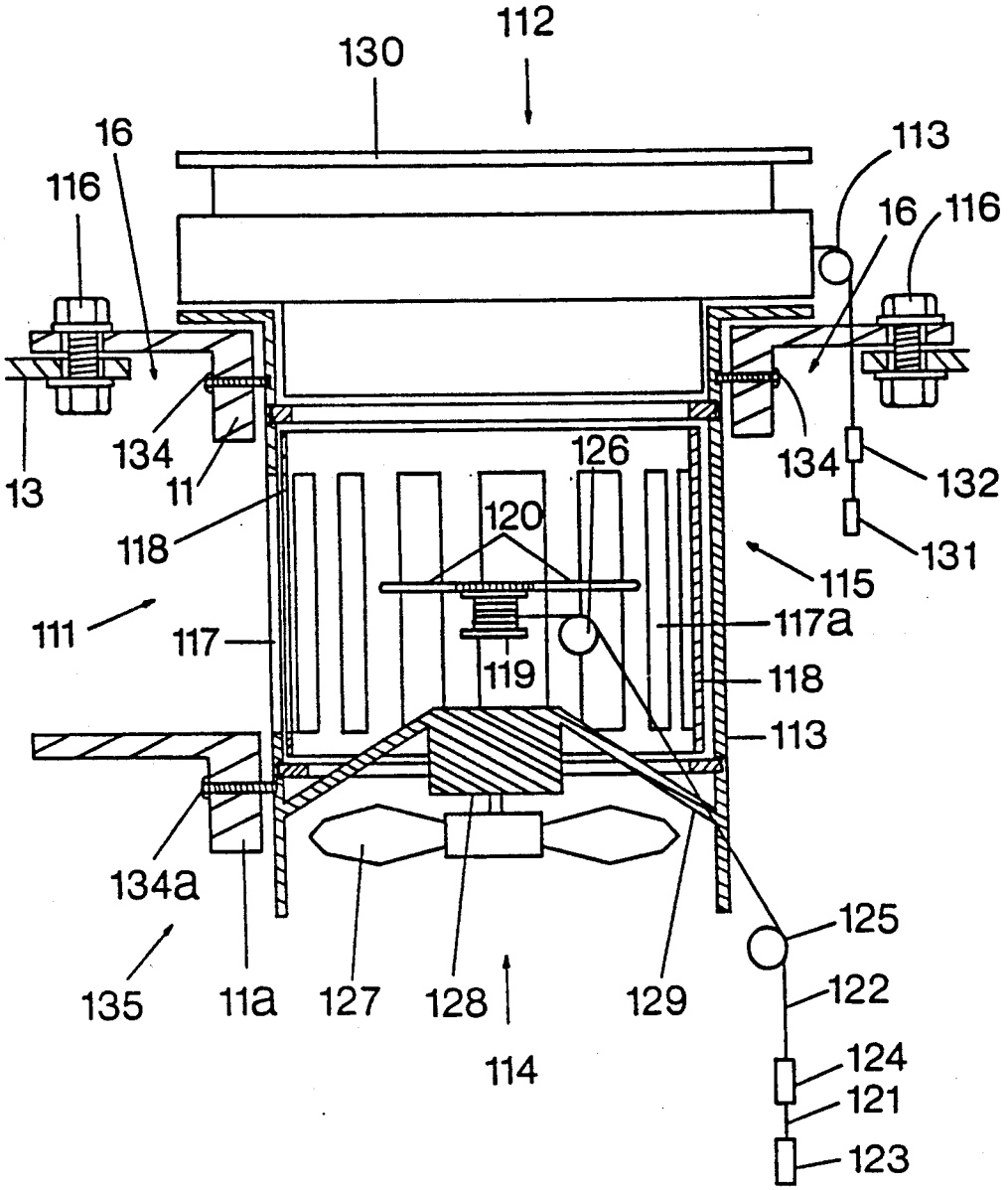

FIG. 8*a*, 8*b*, 8*c* and 8*d* are perspective view of alternative inverted channel shaped members;

FIG. 9 is a schematic side view of an air conditioning unit adapted to heat the air circulated therethrough;

FIG. 10 is a side view of an air conditioning unit that is easy to reverse the duty from heating cycle of FIG. 9 to cooling cycle of this figure and easy to reverse the direction of air flow;

FIG. 11 is a schematic side view of an alternative air conditioning unit adapted to heat or cool the air circulated therethrough;

FIG. 12 is a schematic side view of another airconditioning unit, and

Figure 13:
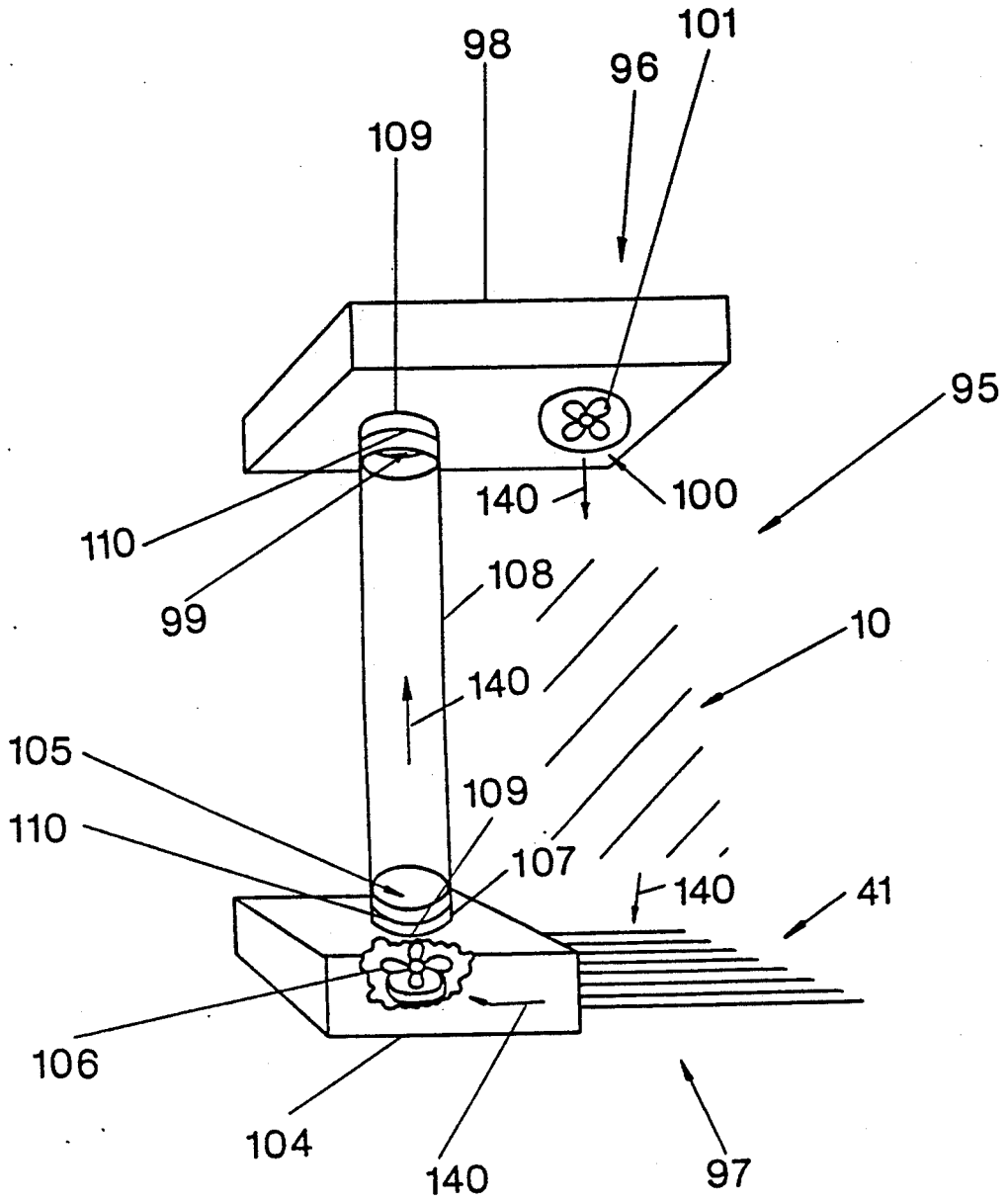

FIG. 13 is a perspective view of an alternative air conditioning unit having cheap flexible and collapsible duct joining the floor components with the ceiling components.

Figure 1:
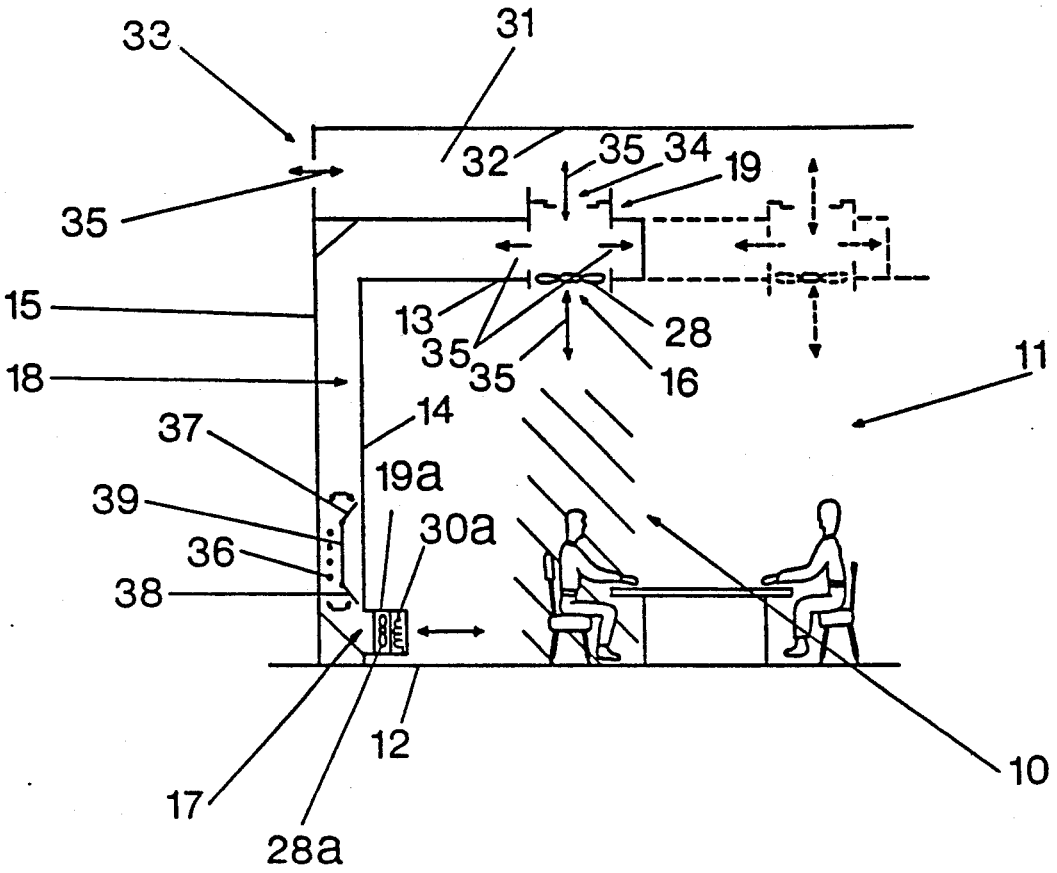
FIG. 1 is a schematic view of an air conditioning apparatus constructed in accordance with the present invention.
Figure 2:
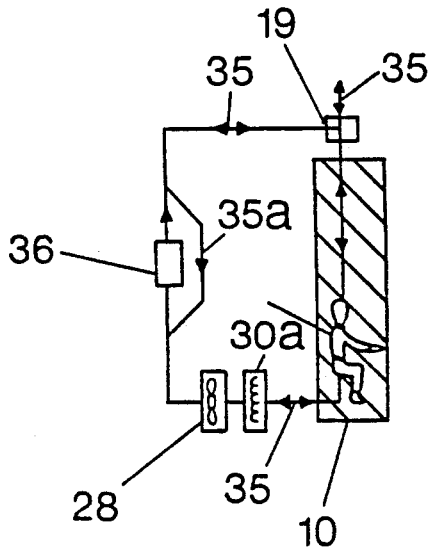
FIG. 2 is a schematic diagram of the apparatus illustrated in FIG. 1.

An object of the present invention is to supply conditioned air to a localized region 10 within a room 11 illustrated in FIGS. 1 and 2. The room 11 of a house or office includes a floor 12, a false ceiling 13 and internal and external walls 14 and 15 respectively.

The false ceiling 13 includes an opening 16 formed therein directly above the localized region 10 through which air may pass. The opening 16 is connected to a similar opening 17, formed in the wall 14 adjacent the floor 12, by a length of ducting 18 sandwich between the internal and external walls 14 and 15 respectively. A flow of air may be driven through the opening 16 and the ducting 18 by the actuation of a fan 28 of an air control unit 19 positioned at the opening 16.

The air control unit 19, illustrated in FIG. 11, includes a first top axial air opening 20, a second side radial air opening 21, and a third bottom axial air opening 22. The unit 19 includes a mounting portion 23 which may incorporate brackets (not shown) enabling the unit 19 to be removably mounted to the ceiling 13. The unit 19 also includes a main body portion 24 which is separated from and hangs beneath the mounting portion 23 on supports 25 and 26. The body portion 24 includes a sleeve 27 which is capable of movement in a vertical direction in order to selectively open or close the radial opening 21. The main body portion 24 also includes a fan 28 driven by a motor 29. Beneath the main body portion 24 there is supported a heat exchanger preferably a cooling unit 30 which may be used to effect cooling of air that is driven out the third axial opening 22.

It will be appreciated that movement of the sleeve 27 in a vertical direction towards the ceiling 13 will close the radial opening 21 thereby preventing the flow of air therethrough.

A passageway 31, separating the false ceiling 13 and the true ceiling 32 of the building, includes a vent 33 formed in the external wall 15 through which fresh air may pass. An opening 34 formed in the ducting 18 opposite the opening 16 formed in the ceiling 13 permits fresh air to be drawn into the room or warm air to be expelled from the room as indicated by arrows 35.

A cooling element 36 intended to cool the air circulated in the localized region 10 is positioned within the ducting 18. The direction of air flowing through the ducting may be diverted around the cooling element 35*a* in FIG. 2 by the selective positioning of baffle plates 37 and 38 which are hingedly connected to a wall 39 which extends between opposing side walls, not shown, of the ducting.

An additional air control unit 19*a*, including a fan 28*a* and a heating unit 30*a*, is fitted to the opening 17 formed in the wall 14. The heating unit 30*a* may be used to effect the heating of air driven through the opening 17.

In use, the rotation of the fans 28 in a direction so as to drive air through the opening 16 in the ceiling 13 and to draw air through the opening 17 formed in the wall 14 will cause air to be conveyed along the ducting 18. The cooling of the air travelling through the ducting 18 may be effected by the selective positioning of the baffle plates 37 and 38, as illustrated in FIG. 1, so as to direct air through the cooling element during operation of same.

Due to the operation of the fans 28, fresh air will be drawn through opening 34 and combined with air drawn from the room. The amount of fresh air mixed with the recycled air may be varied by introducing a valve, not shown, which may selectively open or close opening 34.

It will be appreciated that where the ambient temperature of the room is only a few degrees celsius higher than the temperature of the air outside, the apparatus may be used to deliver fresh air only to the localized region and wherein the air may be recycled or exhausted through doors, windows or exaust ports which are not shown.

To deliver warm air to the localized region 10, the rotational direction of the fans 28 are reversed thereby drawing warm air in through the opening 16 and driving the air along the ducting 18. The orientation of the baffle plates 37 and 38 is also reversed in order to direct the flow of air through the ducting 18 around, rather than through, the cooling element 36.

Heating of the air is effected by the heating unit 30*a* through which the air is driven by fan 28*a*. The warm air, having been expelled through the opening 17 and projected towards the base of the region 10, rises upwardly through the region 10 whereupon the air is drawn through opening 16 and the cycle is repeated. Fresh air is permitted to enter the apparatus via the opening 34 (with fan 28 idle) and through cracks at doors and windows or fresh air inlet ports, not shown. Similarly, warm air may be expelled from the apparatus via the opening 34 in the ducting 18 with fan 28 in operation.

Figure 3:
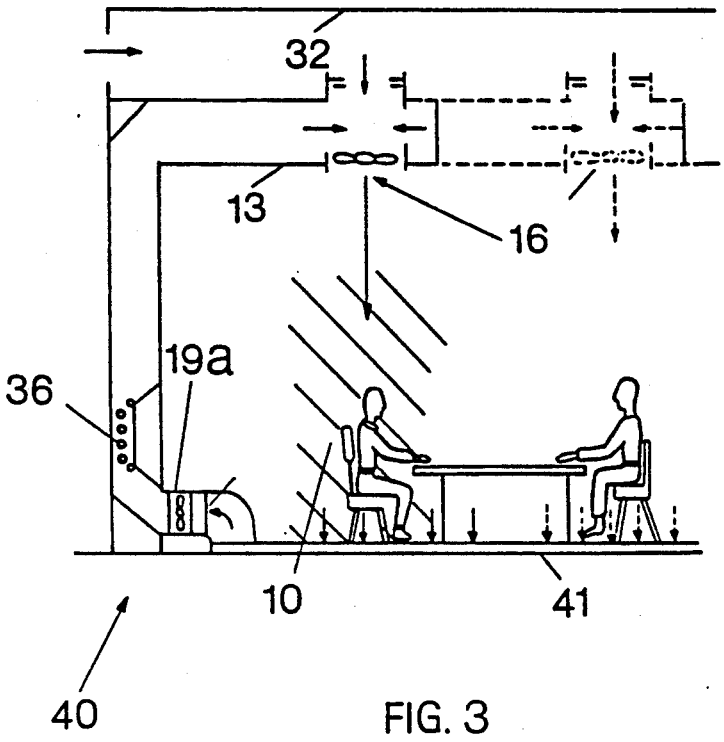
FIG. 3 is a schematic view of another air conditioning apparatus constructed in accordance with the present invention and wherein the apparatus is adapted to supply cool air to a localized region.
Figure 4:
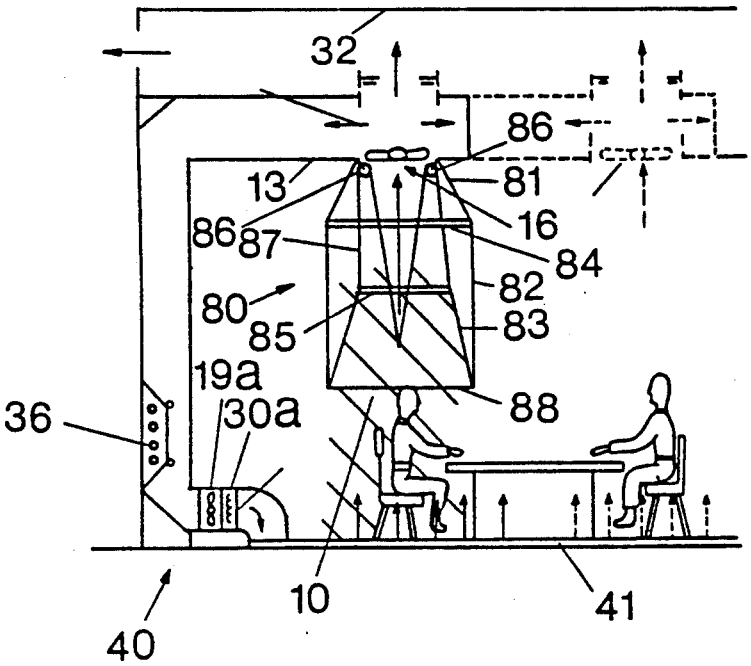
FIG. 4 is a schematic view of the apparatus illustrated in FIG. 3 and wherein the apparatus is adapted to supply warm air to a localized region.
Figure 5:
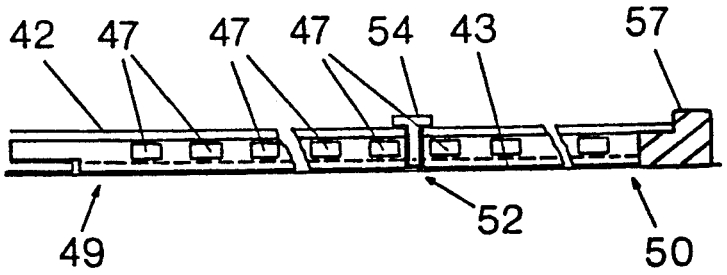
FIG. 5 is a side view of a floor vent.
Figure 6:
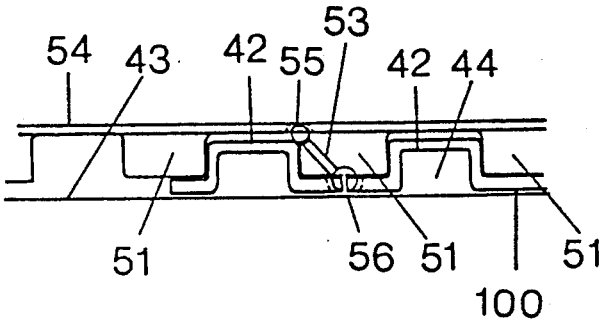
FIG. 6 is an end view of a closure means used to selectively extend the length of the floor vent.
Figure 7:
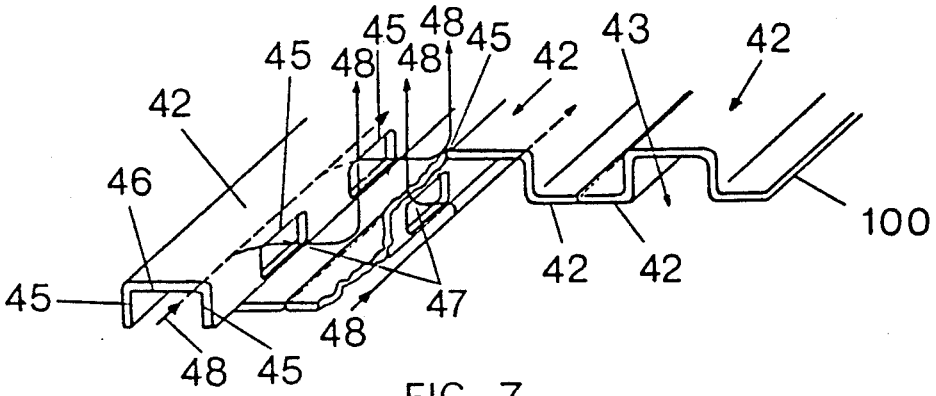
FIG. 7 is a perspective view of a plurality of inverted channel shaped members belonging to the floor vent.

FIGS. 3 and 4 illustrate a similar air conditioning apparatus 40 to that illustrated in FIG. 1 including the addition of a vent 41 located in the floor directly below the localized region 10. The vent 41 includes a plurality of inverted channel shaped members 42 laid side by side on a supporting surface 43 such that the channel shaped members 42 and the supporting surface 43 define a plurality of tubular passageways 44 as shown in FIGS. 5, 6 and 7. Each channel shaped member 42 includes a pair of opposing side walls 45 separated by an intermediate or upper wall 46 having a plurality of windows 47 formed in each of the side walls 45 through which columns of air, indicated by arrows 48, may pass. To prevent the interaction between columns of air expelled from the windows 47 of opposing side walls 45, the windows of opposing channel shaped members 42 are staggered or offset as illustrated in FIG. 7.

In addition, each channel shaped member 42 includes an upstream end 49 and a downstream end 50 as shown in FIGS. 5, 9 and 10. Air may be prevented from passing from the upstream end 49 to the downstream end 50 by the selective location of rectangularly shaped closure members 51 in respective transverse slots 52 cut into each channel shaped member 42. Link members 53, hingedly connected at locations 55 and 56 to a pair of opposed channel shaped members 42 and to a strip 54 of gate members 51 respectively, enable the gate members 51 to be lifted from a position where they block the flow of air passing through the various channel shaped members 42, to a position wherein air may flow from the upstream end 49 to the downstream end 50 of each channel shaped member 42 as illustrated in FIG. 6.

The upstream ends 49 of the channel shaped members 42 are connected to the air control unit 19*a* by a length of ducting 71 of FIGS. 9 and 10. The downstream ends 50 of each channel shaped members 42 are each closed by a seal or stop 57.

Figures 8A, 8B, 8C, 8D:
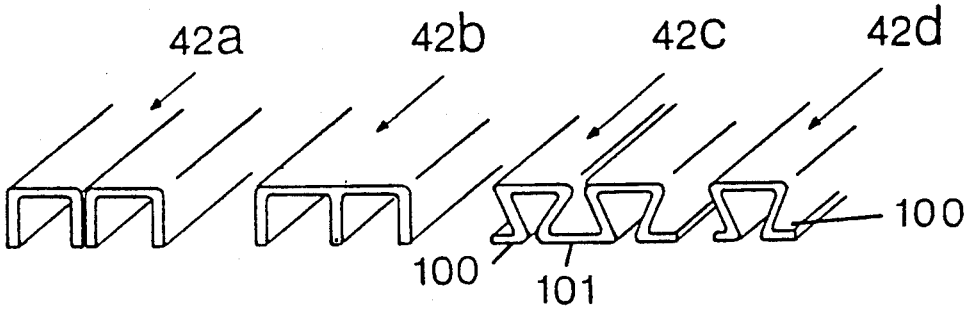

It will be appreciated that the channel shaped members 42*a*, 42*b*, 42*c* and 42*d* as illustrated in FIG. 8, having a profile some what different to the members 42 may be substituted for the members 42 in the embodiments described above. As can be seen from FIGS. 6–8, a series of longitudinal footing elements 100 aid in support and positioning of the channel members 42, 42*a*, 42*c*, and 42*d*. In FIG. 8*c*, the channels are joined by a web 101 joining side-by-side plural channels.

The apparatus illustrated in FIG. 3 may be utilized to cool the air delivered to the localized region 10 in a manner similar to that described in relation to the apparatus illustrated in FIG. 1. Similarly, the apparatus illustrated in FIG. 4 may be used to heat the air delivered to the localized region 10 in a manner similar to that described in FIG. 1. Furthermore, it will be appreciated the inclusion of the collector 80 positioned directly above a person seated in the localized region will result in the capture of the warm air as it rises. The collector 80 will reduce the amount of warm air which is lost to the remainder of the room and will thereby contribute to the overall efficiency of the apparatus. The walls of the collector 80 may be raised by pulling on the draw string provided thereby enabling the person to walk about the room unhindered. It will also be appreciated that the positioning of the vent below the region will result in the delivery of greater volumes of warm air to the region or a more efficient collection of cool air than the apparatus illustrated in FIG. 1.

FIG. 9 illustrates an air control unit 58 intended to heat air circulated therethrough including a blower 59 and a floor vent 60 interconnected by a length of ducting 71. The blower 59 includes a body portion 61 having an inlet port 62, an outlet port 63 and a fan 64 positioned therebetween. The fan 64 is driven by an electric motor 65 shown mounted to the body portion 61 by struts 66. The blower 59 also includes a detachable heating element 67 that can be detached from or attached to the blower quite easily. The heating element 67 is positioned intermediate the fan 64 and the outlet port 63.

The body portion 61 also includes a pair of round symmetrical shoulders 68 and wherein one side of each shoulder rests upon the inclined round opening 69 surrounding the inlet port 70 of the ducting 71. The shoulders 68 and the round opening 69 have the same angle of bevelling such that, after resting the shoulders on the opening, there does not exist a passage between the blower and the ducting through which air might escape. The ducting 71 also includes a neck portion 72 having an outlet port 73 which is connected to the upstream ends 49 of the channel shaped members 42 from which the floor vent 60 is constructed. A seal 57*a* positioned intermediate the neck portion 72 and the external surfaces of the respective channel shaped members 42 prevents any leakage of air therebetween.

The unit 58 may be modified easily in order to also cool the air circulated therethrough as illustrated in FIG. 10. In particular, the orientation of the fan has been reversed and a cooling element 75 is positioned on top of the fan at the port 63. Coolant is supplied to the cooling element 75 by way of supply lines 76.

The particular airconditioning apparatus illustrated in FIG. 4 also includes a collector 80 suspended from the false ceiling 13 immediately below the opening 16 formed therein. The collector 80 includes an upper funnel shaped portion 81, a cylindrical portion 82 and an inside funnel shaped portion 83. All of these are constructed from preferably a flexible material like plastics of the same diameter and folded to form the funnel shapes at both ends. To maintain the cylindrical shape or funnel shapes of the side walls 81, 82 and 83, an annular support member 84 is attached to the intermediate section between the walls 81 and 82 and a smaller annular support member 85 is attached to the end of wall 83; the other end of wall 81 is attached to the ceiling annular support member (not shown).

The collector 80 also includes a length of rope 87 having both ends tied to smaller annular support member 85 while the rope passing through the pulleys 86 attached to the ceiling annular support member (not shown) attached to the opening 16 at the false ceiling 13. By pulling at the middle of the rope 87, the lower edge 88 can be raised toward the false ceiling 13.

FIG. 13 illustrates yet another airconditioning apparatus 95 intended to circulate air within a localized region intermediate the ceiling components 96 and the floor components 97. The ceiling components 96 include an air box 98 having mounting means, not shown, for the mounting of the box to the ceiling. The air box 98 includes an inlet port 99, having an outwardly directed peripheral flange 102, and an outlet port 100 formed therein and wherein there is provided a fan 101 positioned across the outlet port 100.

The floor components 97 include an air box 104 having mounting means, not shown, for the mounting of the box to the floor. The air box 104 includes an inlet port, obscured, which is fluidly connected to a floor vent 41. The air box 104 also includes a fan 106 contained within the box and positioned below an outlet port 105 having an outwardly directed peripheral flange 107.

A length of tubing 108 is used to connect the inlet port 99 and the out let port 105. The ends 109 of the tubing 108 are positioned over and secured to the peripheral flanges 102 and 107 by rubber bands 110.

The apparatus 95 may be easily installed in existing rooms and does not require walls to be removed in order that ducting may be placed therebehind as may be the case with the apparatus illustrated in FIGS. 1 to 4.

In use, actuation of the fans 101 and 106 causes air to be drawn through the floor vent 41, driven along the length of the tubing 108 and expelled through the outlet port 100 in the direction of the localized region 10. Arrows 140 indicate the flow of air around the apparatus 95.

FIG. 12 illustrates an air control unit 111 similar to that illustrated in FIG. 11. The unit 111 includes a body portion 115 located within and suspended from the opening 16 formed in the false ceiling 13. Mounting brackets 11, being affixed to the ceiling 13 by fasteners 116, are used to support the body portion within the opening 16. The body portion is retained in position by bolts 134 which engage the body portion as illustrated.

It will be appreciated that the unit 111 may be positioned substantially above the false ceiling 13 by raising the body portion and again using bolts 134 to retain the body portion in the desired position indicated by arrow 135.

The body portion 115 includes a continuous side wall 113 positioned intermediate a first or top axial opening 112 and a second or bottom axial opening 114. The side wall 113 includes a plurality of slots 117 formed therein which may be selectively opened or closed by the rotation of a sleeve 118, having corresponding slots 117*a* formed therein, within the body portion 115.

The sleeve 118 includes a pulley 119 supported coaxially within the sleeve 118 by arms 120. Two lengths of rope 121 and 122 are attached to and are wound around the pulley 119 in opposite directions and which are supported by pulleys 125 and 126. Rotation of the sleeve 118 is achieved by pulling upon the ends 123 and 124 of the ropes 121 and 122 respectively.

The body portion 115 also includes a fan 127 driven by a motor 128 which is coaxially supported above the opening 114 by arms 129.

The body portion also includes a removable top opening 130 positioned on top of the body portion. The top opening 130 includes a shutter mechanism, similar to that contained in most cameras, which may be selectively opened and closed by pulling ropes 131 and 132, shown supported by a pulley 133.

In use, actuation of the fan 127 will draw fresh air through axial opening 112 and air present in the room through slots 117. The air will in turn be expelled through opening 114. It will be appreciated that the closure of the shutter mechanism of the unit 130 will prevent the flow of fresh air through the unit. Similarly, the closure of slots 117, due to the rotation of sleeve 118, will prevent the flow of room air through the unit. By selectively adjusting the openings created by the shutter mechanism and the sleeve 118, the user may vary both the volume and the mixture of the air delivered to the room by the unit.

It will of course be realised that the above has been given only by way of illustrative example of the present invention and that all such modifications and variations thereto as would be apparent to persons skilled in the art are deemed to fall within the broad scope and ambit of this invention as is herein defined in the appended claims.

I claim:

1. Air conditioning delivery apparatus comprising:

a) a region enclosing a volume of air within a space at least partially defined by an upper surface and a lower surface;

b) an air flow system associated with said region forming one or more air flow loops including;

i) means for redirecting floor air to said region vertically disposed within said space, said means for redirecting floor air located substantially directly beneath said region at said lower surface and further comprising a plurality of downward-facing elongated channel members laid side by side on a supporting surface such that the channels and supporting surface form a plurality of passageways, each of said channel members including a plurality of aperture means on at least one side of the channel member for redirecting air through said region;

ii) at least one air collection means for collecting air from said region;

iii) ducting means for transferring air between said means for redirecting and said air collection means;

iv) means for moving air being located within said one or more air flow loops of said air flow system;

v) means for air temperature adjustment situated within at least one of said air flow loops;

vi) means for fresh air ingress communicating with the air flow system;

wherein said air collection means comprises an overhead hood extending downward form the upper surface, including:

A) a top portion, wherein said top portion forms an envelope joining an aperture in the upper surface, and B) a flexible lower portion, said lower portion being of a flexible material joined at an upper edge thereof t the top portion with an outer ring and further including: an outer portion, and a mobile inner portion joined at a lower edge thereof to an inner ring, said inner portion being formed from the lower portion by folding the lower portion inside itself; and C) plural lines attached to the inner ring and passing through at least tow pulley means located above the lower portion for raising the lower edge to a desired height.

2. Air conditioning delivery apparatus as in claim 1, further including a plurality of channel members lying side by side on a supporting surface to form a series of air passageways, having at least one longitudinal footing along each channel, adapted to support masses above the plurality of channels.

3. Air conditioning delivery apparatus as in claim 1, wherein each channel member has parallel longitudinal edges, further including a series of tie-in joining members between both edges of each channel along its whole length to prevent relative movement of both edges of the channel upon application of a load to the top of the channel.

4. Air conditioning delivery apparatus as in claim 1, wherein said air flow system further includes gate means in at least one of said loops for selecting air flow to plural regions.

5. Air conditioning delivery apparatus as in claim 1, wherein at least two channels are joined side by side to form a plurality of air passageways.

6. Air conditioning delivery apparatus as in claim 1, further including a series of tie-in joining members between both edges of each channel along its whole length to prevent separation of members or creeping in toward each other of both edges of the channel when load is applied on top of the channel surface.

7. Air conditioning delivery apparatus as claimed in claim 1, further including means for blocking air flow along at least one channel.

* * * * *